US011848490B2

(12) United States Patent
Takahashi

(10) Patent No.: US 11,848,490 B2
(45) Date of Patent: Dec. 19, 2023

(54) COVER ASSEMBLY

(71) Applicant: DKK Co., Ltd., Tokyo (JP)

(72) Inventor: Higeyoshi Takahashi, Tokyo (JP)

(73) Assignee: DKK Co., Ltd.

( * ) Notice: Subject to any disclaimer, the term of this patent is extended or adjusted under 35 U.S.C. 154(b) by 755 days.

(21) Appl. No.: 16/926,120

(22) Filed: Jul. 10, 2020

(65) Prior Publication Data

US 2021/0036417 A1 Feb. 4, 2021

(30) Foreign Application Priority Data

Jul. 16, 2019 (JP) ..... 2019-131243

(51) Int. Cl.
*H01Q 1/42* (2006.01)
*E04H 12/00* (2006.01)

(52) U.S. Cl.
CPC ..... *H01Q 1/42* (2013.01); *E04H 12/003* (2013.01)

(58) Field of Classification Search
CPC ..... H01Q 1/42; E04H 12/003
USPC ..... 343/872
See application file for complete search history.

(56) References Cited

U.S. PATENT DOCUMENTS

| | | | |
|---|---|---|---|
| 3,837,418 | A | 9/1974 | Kawashiro |
| 6,111,553 | A | 8/2000 | Steenbuck |
| D437,426 | S | 2/2001 | Ginsburg |
| D671,654 | S | 11/2012 | Akamatsu et al. |
| D679,026 | S | 3/2013 | Akamatsu et al. |
| D711,557 | S | 8/2014 | Halfmann |
| D737,997 | S | 9/2015 | Cassidy |
| D754,880 | S | 4/2016 | Reusing |
| 9,581,207 | B2 | 2/2017 | Tokieda |
| D792,613 | S | 7/2017 | Bar-or |
| D817,915 | S | 5/2018 | Norrell |
| D817,916 | S | 5/2018 | Norrell |
| 10,422,014 | B2 | 9/2019 | Shimbe et al. |
| D925,776 | S | 7/2021 | Wendt |
| 2003/0117337 | A1 | 6/2003 | Lendriet |
| 2009/0155001 | A1 | 6/2009 | Kim et al. |
| 2013/0028666 | A1 | 1/2013 | Atchley et al. |
| 2015/0057047 | A1 | 2/2015 | Hendrix et al. |
| 2017/0301977 | A1 | 10/2017 | Caldwell et al. |

(Continued)

FOREIGN PATENT DOCUMENTS

| | | | |
|---|---|---|---|
| CN | 103669959 | A | 3/2014 |
| CN | 205828663 | U | 12/2016 |

(Continued)

OTHER PUBLICATIONS

Japanese Office Action for Application No. 2020-054646 dated Dec. 7, 2021, 4 Pages.

*Primary Examiner* — Peguy Jean Pierre
(74) *Attorney, Agent, or Firm* — Lerner David LLP

(57) ABSTRACT

Various devices are efficiently mounted on a pole while reducing the probability of spoiling the view around the pole. A cover assembly 100 includes a plurality of covers 1 and 2, the outer shapes of the covers being respectively shapes obtained by dividing a hollow elongated body at predetermined intervals in the circumferential direction, each of the covers having an internal housing space portion; and mounting mechanisms 5 to 8 for mounting the covers on a pole 9 located to be surrounded by the inner peripheral face of each of the covers in a state in which the covers are arranged to form a hollow elongated body as a whole.

4 Claims, 9 Drawing Sheets

(56) References Cited

U.S. PATENT DOCUMENTS

| | | | | |
|---|---|---|---|---|
| 2019/0140347 | A1 | 5/2019 | Bouchard | |
| 2019/0261456 | A1 | 8/2019 | Lee et al. | |
| 2020/0182451 | A1* | 6/2020 | Girouard | F21V 29/83 |
| 2021/0036417 | A1 | 2/2021 | Takahashi | |
| 2021/0336331 | A1* | 10/2021 | Rai | H01Q 21/28 |

FOREIGN PATENT DOCUMENTS

| | | | |
|---|---|---|---|
| JP | H10152893 | A | 6/1998 |
| JP | 2006129373 | A | 5/2006 |
| JP | 2012075240 | A | 4/2012 |
| JP | 2017158119 | A | 9/2017 |
| JP | 2018046505 | A | 3/2018 |
| KR | 20180043707 | A | 4/2018 |

* cited by examiner

COVER ASSEMBLY

CROSS REFERENCE TO RELATED APPLICATIONS

The present application claims priority from Japanese Patent Application No. 2019-131243, filed on Jul. 16, 2019, which is incorporated by reference herein in its entirety.

FIELD OF THE INVENTION

The present disclosure relates to a cover assembly with a plurality of covers.

DESCRIPTION OF RELATED ART

Patent Literature 1 describes an antenna that is mounted on a building structure, such as an installed pole, via antenna mounting brackets, for example.

CITATION LIST

Patent Literature

Patent Literature 1: Japanese Patent Application Laid-Open No. 2017-158119

SUMMARY OF THE INVENTION

When the middle part of a pole is provided with brackets that project horizontally from the pole, and various devices, such as antennae, are mounted on the pole via the brackets, the view around the pole may be spoiled.

In view of the foregoing, it is an object of the present disclosure to efficiently mount various devices on a pole while reducing the possibility of spoiling the view around the pole.

A cover assembly according to the present disclosure includes a plurality of covers, outer shapes of the covers being respectively shapes obtained by dividing a hollow elongated body at predetermined intervals in a circumferential direction, and each of the covers having an internal housing space portion; and a mounting mechanism for mounting the covers on a pole located to be surrounded by an inner peripheral face of each of the covers in a state in which the covers are arranged to form a hollow elongated body as a whole.

According to the present disclosure, various devices can be efficiently mounted on a pole with a reduced probability of spoiling the view around the pole.

DETAILED DESCRIPTION OF PREFERRED EMBODIMENTS

Figure 1:
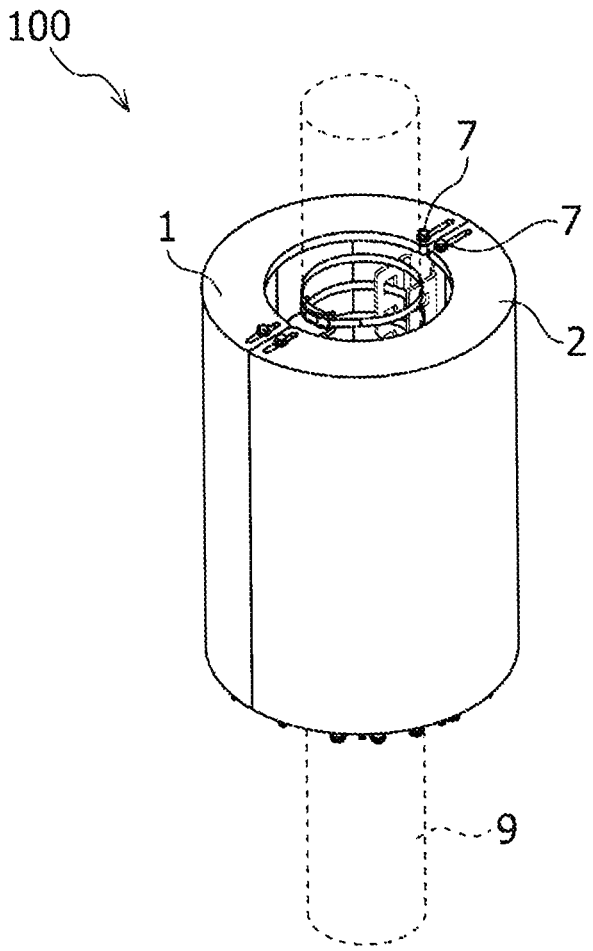
FIG. 1 is a perspective view of an antenna cover assembly.
Figure 2:
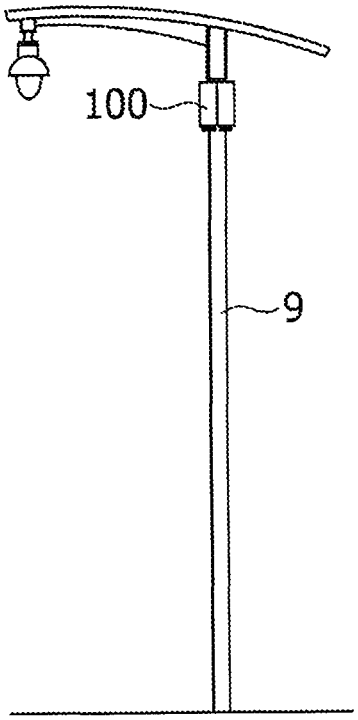
FIG. 2 is an explanatory view illustrating a state in which the antenna cover assembly is mounted on a pole.
Figure 3:
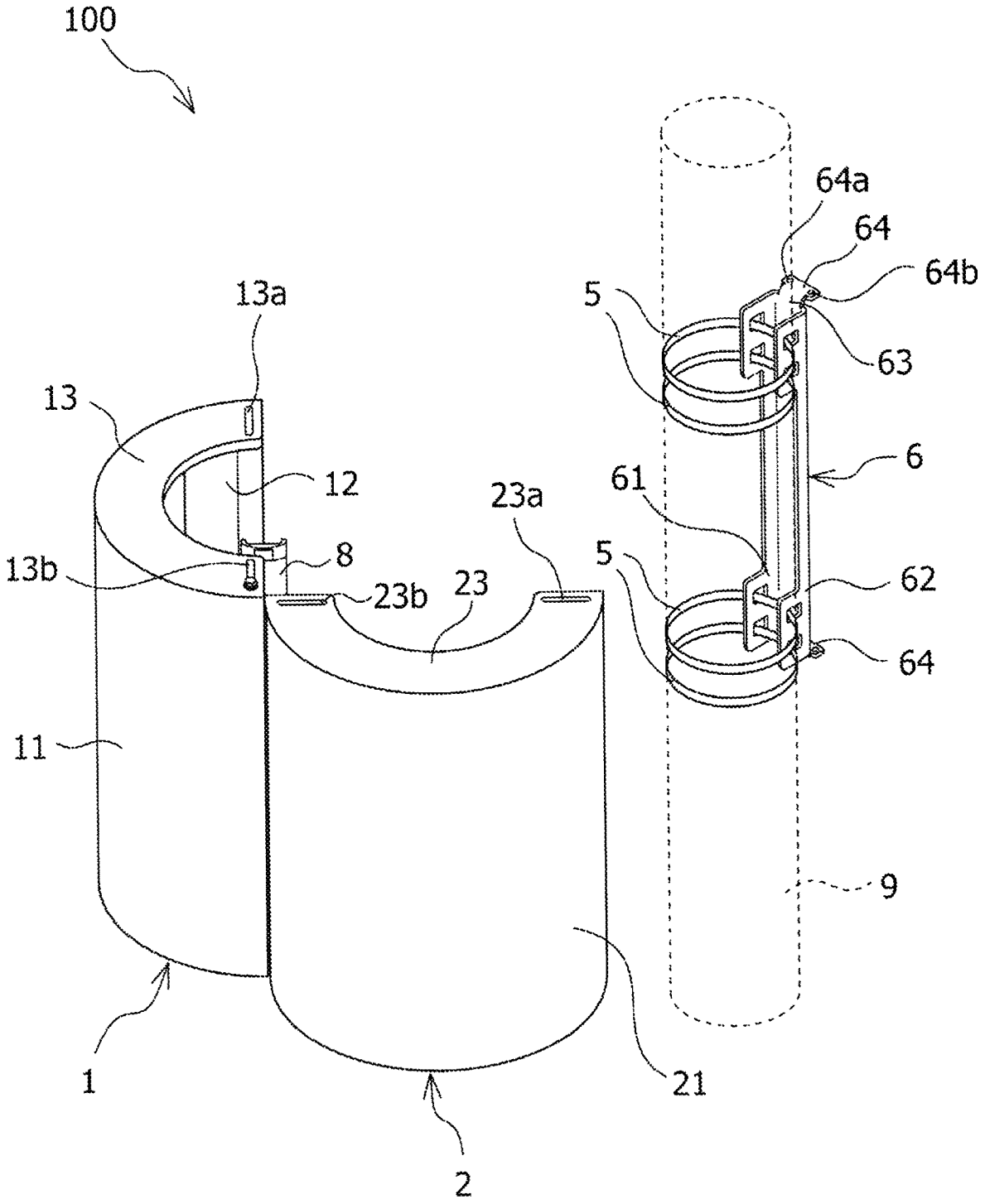
FIG. 3 is a perspective view illustrating the mounting of the antenna cover assembly.
Figure 4:
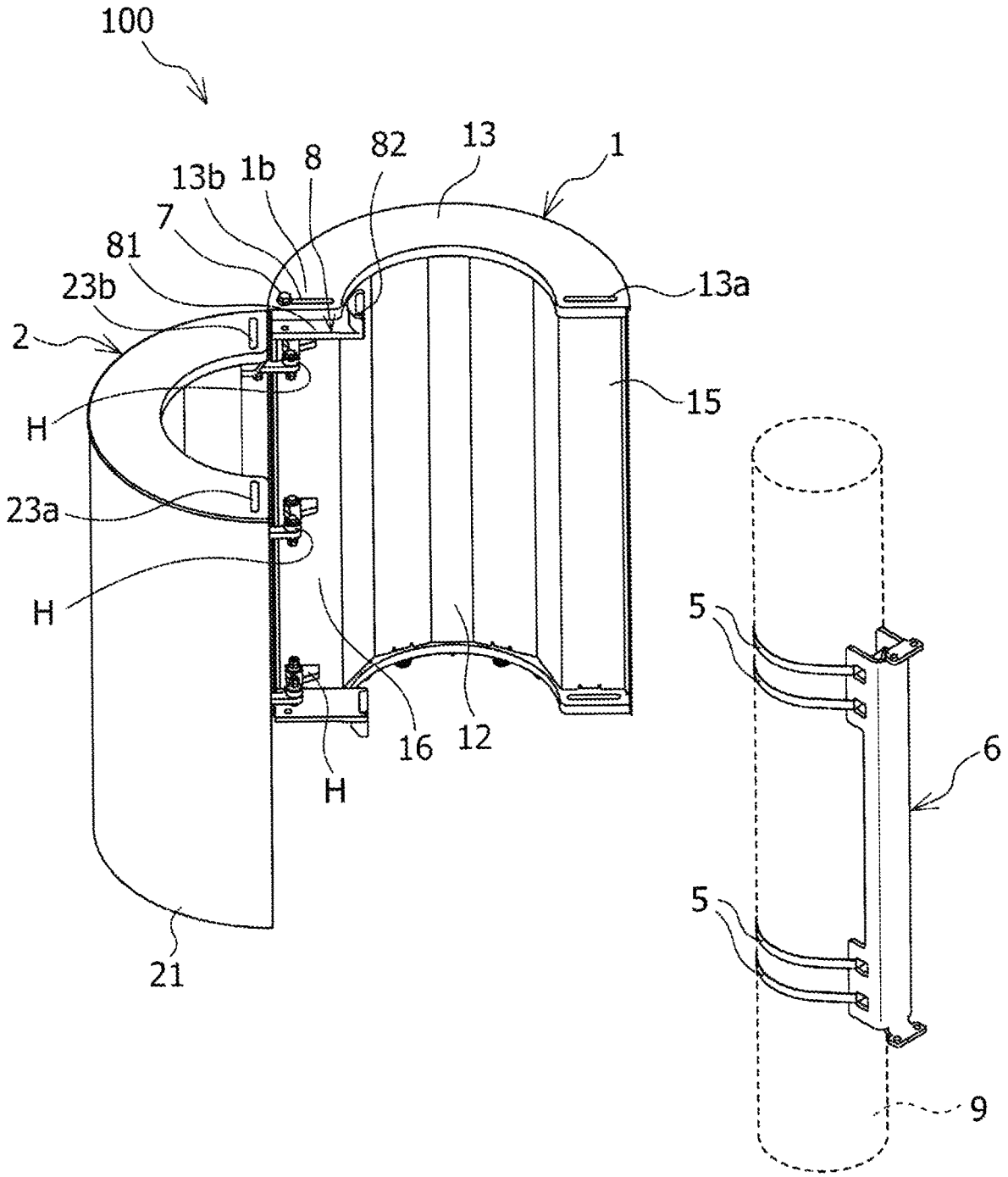
FIG. 4 is another perspective view illustrating the mounting of the antenna cover assembly.

Hereinafter, embodiments of the present invention will be described with reference to the drawings. It should be noted that the present invention is not limited by the following embodiments.

As illustrated in FIGS. 1 to 5, an antenna cover assembly 100 includes a first antenna cover 1 and a second antenna cover 2. Each of the first antenna cover 1 and the second antenna cover 2 has the outer shape that is approximately a half of hollow cylindrical body, and has an internal space portion S for housing an antenna element. The antenna element is arranged such that it faces radially outward within the space portion S, and radiates electromagnetic waves radially outward and receives incoming electromagnetic waves that travel radially inward from the outside of the antenna cover. The first antenna cover 1 and the second antenna cover 2 have approximately the same size. The first antenna cover 1 and the second antenna cover 2 are made of fiber-reinforced plastic (FRP), for example.

The first antenna cover 1 includes an outer peripheral face 11, an inner peripheral face 12, an axial upper end face 13 and an axial lower end face (provided that the axial direction of the half of hollow cylindrical body coincides with the vertical direction), and opposite circumferential end faces. The second antenna enclosure 2 includes an outer peripheral face 21, an inner peripheral face 22, an axial upper end face 23 and an axial lower end face (provided that the axial direction of the half of hollow cylindrical body coincides with the vertical direction), and opposite circumferential end faces.

One of opposite circumferential ends of the first antenna cover 1 is referred to as a first circumferential end 1*a*, and the other is referred to as a second circumferential end 1*b*. Meanwhile, one of opposite circumferential ends of the second antenna cover 2 that faces the first circumferential end 1*a* of the first antenna cover 1 in a state in which the first antenna cover 1 and the second antenna cover 2 are arranged so as to form an approximately hollow cylindrical body as a whole, is referred to as a first circumferential end 2*a* of the second antenna cover 2. In addition, the other of the opposite circumferential ends of the second antenna enclosure 2 that faces the second circumferential end 1*b* of the first antenna cover 1 in the aforementioned state, is referred to as a second circumferential end 2*b* of the second antenna cover 2.

The antenna cover assembly 100 further includes a hinge portion H that joins the second circumferential end 1*b* of the first antenna cover 1 to the second circumferential end 2*b* of the second antenna cover 2 and that can move in the axial direction. The hinge portion H is disposed such that it can adjust the distance D between the first circumferential end 1*a* of the first antenna cover 1 and the first circumferential end 2*a* of the second antenna cover 2. Thus, the antenna cover assembly 100 is a so-called clamshell type.

When the antenna cover assembly 100 is mounted on the pole 9, the first antenna cover 1 and the second antenna cover 2 are moved at the hinge portion H so that the distance D is increased. With the distance D increased, the first antenna cover 1 and the second antenna cover 2 are put closer to the pole 9 so that the pole 9 is located between the inner peripheral faces of the two antenna covers. After that, the two antenna covers are moved at the hinge portion H so that the distance D is brought to zero. Next, the antenna cover assembly 100 is fixed to the pole 9 using a mounting mechanism (described below) of the antenna cover assembly 100.

The mounting mechanism is a mechanism for mounting the first antenna cover 1 and the second antenna cover 2 on the pole 9, which is located between the inner peripheral face 12 of the first antenna cover 1 and the inner peripheral face 22 of the second antenna cover 2, in a state in which the first antenna cover 1 and the second antenna cover 2 are arranged so as to form an approximately hollow cylindrical body as a whole. Examples of the pole 9 include utility poles, support posts for street lamps, and signal posts.

The mounting mechanism includes a plurality of ring-shaped parts 5, a first bracket 6, bolts 7, and a second bracket 8, for example. The plurality of ring-shaped parts 5 are attached to the pole 9 at intervals in the height direction of the pole 9 (that is, the vertical direction) so as to be in contact with the outer peripheral face of the middle part of the pole 9.

The first bracket 6 is generally in a thin, elongated shape and has an approximately U-shaped cross-sectional structure that is perpendicular to the longitudinal direction. The first bracket 6 includes a first planar portion 61 and a second planar portion 62 that face each other in the horizontal direction, and a third planar portion 63 coupling the first planar portion 61 to the second planar portion 62 in a state in which the first bracket 6 is arranged with its longitudinal direction coinciding with the vertical direction. The first planar portion 61 is provided with a plurality of holes at intervals in the longitudinal direction, and the second planar portion 62 is also provided with a plurality of holes facing the corresponding holes of the first planar portion 61.

Each ring-shaped part 5 is attached to the pole 9 while being inserted through one of the plurality of holes provided in the first planar portion 61 and the corresponding hole of the second planar portion 62. This allows the first bracket 6 to be attached to the pole 9 with the first planar portion 61 and the second planar portion 62 in contact with the pole 9.

The first bracket 6 has formed thereon fourth planar portions 64 that extend in the horizontal direction and a direction away from the pole 9, from opposite ends of the third planar portion 63 in the longitudinal direction. Each fourth planar portion 64 is provided with two holes 64*a* and 64*b* at intervals in the direction parallel with the circumferential direction of the ring-shaped parts 5.

Meanwhile, the opposite circumferential ends of the axial upper end face 13 of the first antenna cover 1 are shaped such that they respectively project in the circumferential direction from the opposite circumferential end faces 15 and 16. The two projecting portions have elongated holes 13*a* and 13*b*, respectively, that are provided in the axial direction and are radially elongated. In addition, the opposite circumferential ends of the axial upper end face 23 of the second antenna cover 2 are shaped such that they respectively project in the circumferential direction from the opposite circumferential end faces. The two projecting portions have elongated holes 23*a* and 23*b*, respectively, that are provided in the axial direction and are radially elongated.

Similarly, the opposite circumferential ends of the axial lower end face of the first antenna cover 1 are also shaped such that they respectively project in the circumferential direction from the opposite circumferential end faces 15 and 16. Each of the two projecting portions has an elongated hole that is provided in the axial direction and is radially elongated. In addition, the opposite circumferential ends of the axial lower end face of the second antenna cover 2 are shaped such that they respectively project in the circumferential direction from the opposite circumferential end faces. Each of the two projecting portions has an elongated hole that is provided in the axial direction and is radially elongated.

When the cover assembly is closed (that is, when the distance D is zero), bolts 7 are disposed so as to penetrate through the elongated hole 13*a* and the hole 64*a* and through the elongated hole 23*a* and the hole 64*b*, respectively. The respective bolts 7 can be moved along the radially elongated holes 13*a* and 23*a* according to the diameter of the pole 9 and thus can be fixed in place.

The second bracket 8 is generally in an approximate L-shape, and includes a first planar portion 81 located axially inward of the elongated hole 13*b* of the first antenna cover 1 and extending in the horizontal direction, and a second planar portion 82 extending axially outward from the radially inner end of the first planar portion 81.

The first planar portion 81 is provided with two holes at intervals in the circumferential direction. A bolt 7 is disposed so as to penetrate through one of the holes and the elongated hole 13*b*. When the cover assembly is closed (that is, when the distance D is zero), another bolt 7 is disposed so as to penetrate through the other hole of the first planar portion and the elongated hole 23*b*. The positions of the bolts 7 fastened through the elongated holes 13*b* and 23*b* are radially adjustable.

The second planar portion 82 is attached to the pole 9 via ring-shaped parts that are similar to the ring-shaped parts 5 for fixing the first bracket 6.

Elongated holes that are similar to the elongated holes 13*a* and 13*b* are also provided in the axial lower end face of the first cover 1. In addition, elongated holes that are similar to the elongated holes 23*a* and 23*b* are also provided in the axial lower end face of the second cover 2. Attachment that is similar to the attachment to the pole 9 described with reference to the elongated holes 13*a* and 13*b* and the elongated holes 23*a* and 23*b*, is also conducted through the elongated holes provided in the axial lower end face of the first cover 1 and through the elongated holes provided in the axial lower end face of the second cover 2.

In this manner, the antenna cover assembly 100 is mounted on the pole 9 using the mounting mechanism that includes the ring-shaped parts 5, the first bracket 6, the bolts 7, and the second bracket 8 so that the central axis of the antenna cover assembly 100 is coaxially aligned with the central axis of the pole 9.

As described above, the antenna cover assembly 100, which is an approximately hollow cylindrical body, can be mounted on the middle part of the pole 9 so as to surround the outer peripheral face of the pole 9. That is, the pole is located within the hollow portion of the approximately hollow cylindrical antenna cover assembly 100. In addition, each of the antenna elements housed within the space portions of the two antenna covers radiates electromagnetic waves radially outward and receives incoming electromagnetic waves that travel radially inward from the outside of the antenna covers. There is no possibility of the pole 9 being located on the propagation path of electromagnetic waves for each of the antenna elements. Therefore, degradation of the antenna electrical properties (in particular, degradation of the horizontal-plane directional characteristics) due to the pole 9 can be reduced. This is particularly advantageous when the antenna used is a horizontal omnidirectional antenna.

Figure 6:
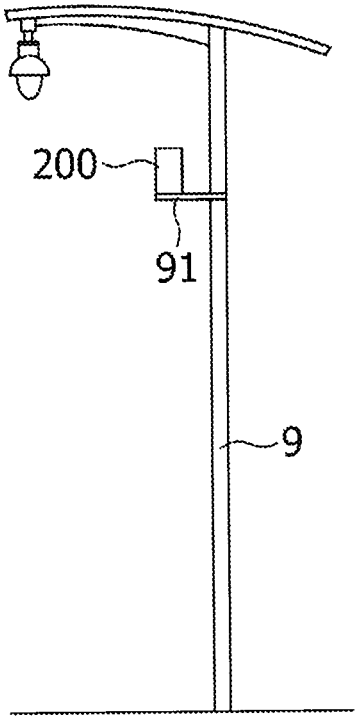
FIG. 6 is an explanatory view of a first comparative example.

As a comparative example, FIG. 6 illustrates a state in which an antenna 200 is mounted on a pole 9 with a bracket 91 that projects horizontally from the middle part of the pole 9. In such a case, the pole 9 may be located on the propagation path of electromagnetic waves for the antenna 200 depending on the propagation path, which in turn may degrade the antenna electrical properties, such as the horizontal-plane directional characteristics and the reflectance properties.

Figure 7:
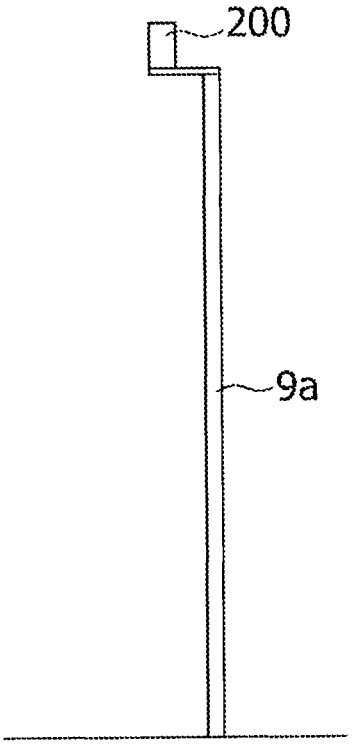
FIG. 7 is an explanatory view of a second comparative example.

Meanwhile, as illustrated in FIG. 7, if the antenna 200 can be mounted at the top of a pole 9*a*, degradation of the antenna electrical properties can be reduced. However, since the position of the antenna 200 is limited to the top of the pole, mounting flexibility is lower than when the antenna is mounted on the middle part of a pole having a given range. Furthermore, a mounting such as the one illustrated in FIG. 7 is often impossible in practice because other parts, such as a lightning rod, are already disposed at the top of the pole 9*a*, for example.

According to the embodiment illustrated in FIGS. 1 to 5, it is possible to reduce degradation of the antenna electrical properties while effectively utilizing a space around the middle part of a pole. Also, an antenna can be easily mounted on the middle part of the pole. In addition, since the antenna is disposed coaxially with the pole so as to surround the pole, spoiling of the view around the pole can be reduced in comparison with when the antenna is mounted on the pole with a bracket that projects horizontally from the pole.

Furthermore, as the antenna is coaxially mounted on the pole, the wind load on the antenna can be reduced and the load on the pole can also be reduced. In particular, a reduction in the rotation moment due to the wind load can be expected in comparison with the configuration illustrated in FIG. 6, and thus, mounting strength with respect to the pole can be lowered to a certain degree.

Furthermore, a relatively small number of parts is needed for mounting the antenna cover assembly on the pole. In addition, with the elongated holes 13*a* and 23*a*, the fixation positions of the bolts 7 can be adjusted in accordance with the diameter of the pole on which the antenna cover assembly is adapted to be mounted. That is, the antenna cover assembly can be easily mounted on the middle part of the pole.

Moreover, the first antenna cover and the second antenna cover can be easily positioned with respect to each other with the hinge portion H.

Although elongated holes are illustrated as examples of the position adjustment mechanism that can be applied to poles with different diameters, the present invention is not limited thereto. The length of a projecting arm that couples the antenna cover to the outer periphery of the pole may be adjusted not through the elongated holes of the antenna covers but with the use of the first bracket 6.

Figure 8:
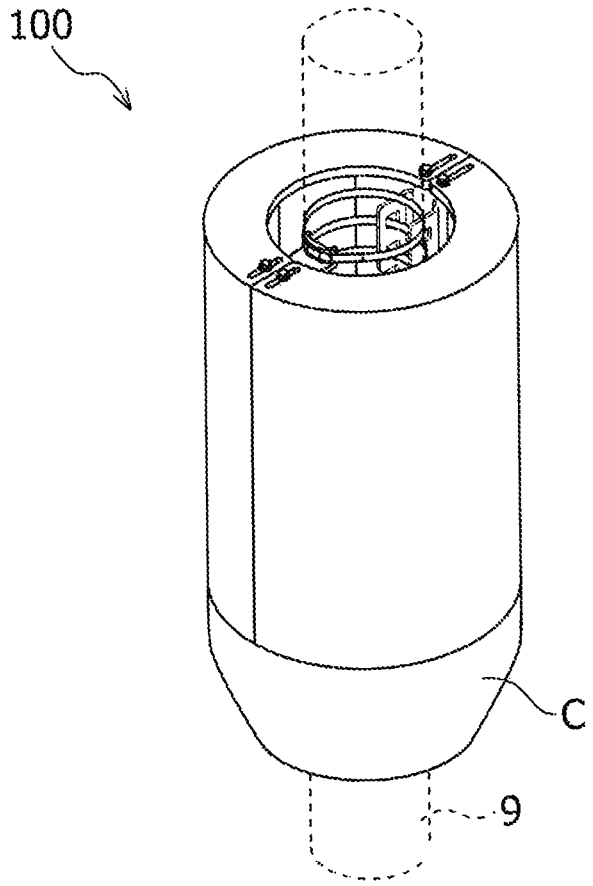
FIG. 8 is a perspective view illustrating a state in which another cover is attached to the bottom face.

Cables for supplying current to the antenna elements within the space portions of the two antenna covers can be extended downward through terminals that are respectively provided at the axial lower end faces of the antenna covers. In such a case, as illustrated in FIG. 8, a cover C may be attached to the bottom face of the antenna cover assembly 100 that has been mounted on the pole 9, so as to hide the terminals.

In recent years, to increase network density, antennae have become more likely to be installed not on big towers but on small poles. According to the aforementioned embodiment, an antenna can be installed by effectively utilizing a dead space, such as the middle part of a lighting pole by the side of the street or the middle part of a signal pole, without significantly spoiling the view around the pole.

Although an antenna cover assembly with antenna covers each housing an antenna element has been described above, the present invention is not limited thereto. Cover assemblies having housing space portions that house various devices can be provided. Examples of the various devices include, in addition to antenna elements, wireless communication devices including, for example, distributors for distributing electricity to antenna elements; IoT devices, such as various sensors and modules; and devices used for monitoring camera systems and digital signage, etc.

It is also possible to dispose displays or projectors used for digital signage on the outer peripheral faces of the cover 1 and the cover 2.

Figure 5:
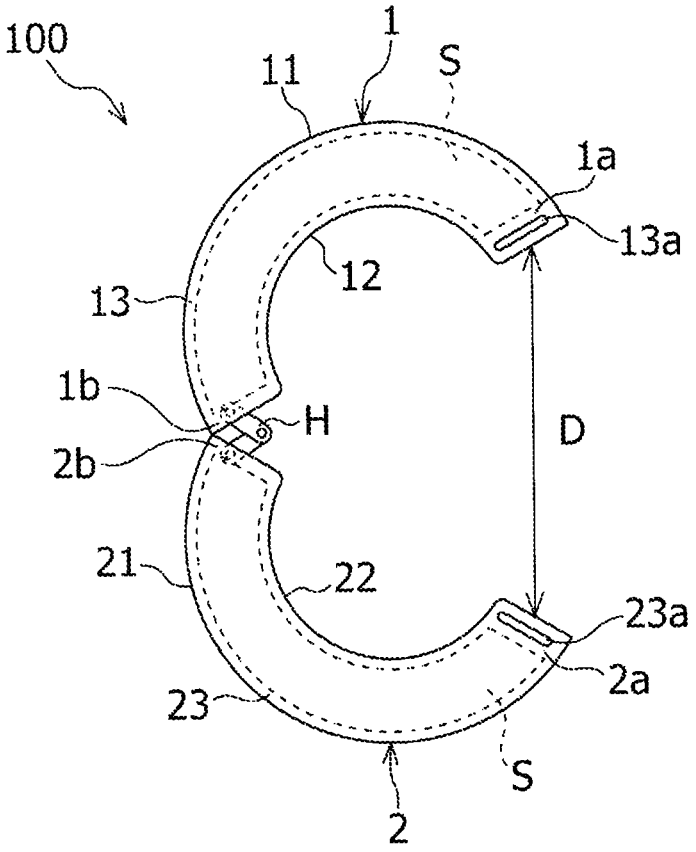
FIG. 5 is a plan view illustrating the mounting of the antenna cover assembly.
Figure 9:
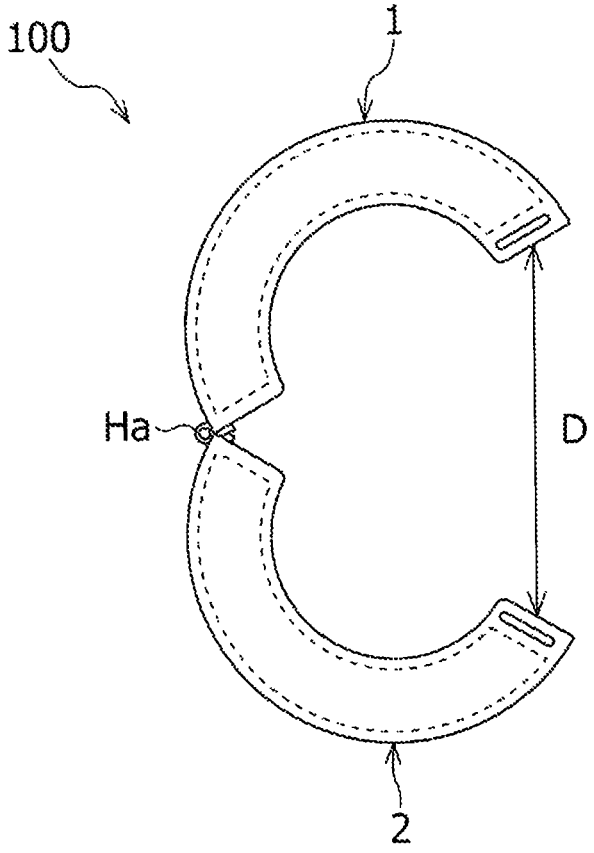
FIG. 9 is a plan view of another example of a hinge portion.

Although FIG. 5 illustrates the hinge portion H with a rotating shaft portion located on the inner side in the circumferential direction than the position at which the hinge is attached to the covers 1 and 2 as an example of the hinge portion, the present invention is not limited thereto. As illustrated in FIG. 9, a hinge portion Ha can also be used that has a rotating shaft portion located on the outer side in the circumferential direction than the position at which the hinge is attached to the covers 1 and 2 and on the outer side of the outer peripheral faces of the covers 1 and 2.

The hinge portion is not an essential component. When the hinge portion is not provided, the cover 1 and the cover 2 may be combined so as to form an approximately hollow cylindrical body as a whole with the pole 9 interposed therebetween, and then the covers may be fixed together.

Although two approximately halves of hollow cylindrical body obtained by cutting an approximately hollow cylindrical body vertically in half are illustrated as the covers in the aforementioned embodiment, the present invention is not limited thereto. The covers of the cover assembly may suffice if the outer shapes of the covers are respectively shapes obtained by dividing a hollow elongated body, such as a cylinder or a rectangular tube, at predetermined intervals in the circumferential direction, and each of the covers have an internal housing space portion.

Supplements to the aforementioned embodiment are further disclosed below.

Supplement 1

The cover assembly includes a plurality of covers, outer shapes of the covers being respectively shapes obtained by dividing a hollow elongated body at predetermined intervals in a circumferential direction, and each of the covers having an internal housing space portion; and a mounting mechanism for mounting the covers on a pole located to be surrounded by an inner peripheral face of each of the covers in a state in which the covers are arranged to form a hollow elongated body as a whole.

Supplement 2

The number of covers may be two. In such a case, the cover assembly includes a hinge portion adapted to, when the two covers are arranged so as to form the hollow elongated body as a whole, join one circumferential end of one of the covers and one circumferential end of another cover that are adjacent to each other so that a distance between another circumferential end of the one of the covers and another circumferential end of the other cover is adjustable.

Supplement 3

The number of covers is n. It should be noted that n is an integer not less than 3. The cover assembly may further includes a hinge portion adapted to, when a first cover to an n-th cover are sequentially arranged adjacent to each other in the circumferential direction so as to form the hollow elongated body as a whole, join a circumferential end of a k-th cover and a circumferential end of a (k+1)th cover that are adjacent to each other so that a distance between a circumferential end of the n-th cover and a circumferential end of the first cover that are adjacent to each other in the circumferential direction is adjustable. It should be noted that k is an integer not less than 1 and not greater than n−1.

Although specific embodiments of the present invention have been described above, the present invention is not limited thereto, and various changes that are based on the technical idea of the present invention are encompassed by the concept of the present invention.

REFERENCE SIGNS LIST

100 Antenna cover assembly
1 First antenna cover
11 Outer peripheral face
12 Inner peripheral face
13 Axial upper end face
1*a* First circumferential end
1*b* Second circumferential end
2 Second antenna cover
21 Outer peripheral face
22 Inner peripheral face
23 Axial upper end face
2*a* First circumferential end
2*b* Second circumferential end

What is claimed is:

1. A cover assembly comprising:

a plurality of covers, outer shapes of the covers being respectively shapes obtained by dividing a hollow elongated body at predetermined intervals in a circumferential direction, and each of the covers having an internal housing space portion; and a mounting mechanism for mounting the covers on a pole located to be surrounded by an inner peripheral face of each of the covers in a state in which the covers are arranged to form a hollow elongated body as a whole, wherein the number of covers is two, and the cover assembly further comprises a hinge portion adapted to, when the two covers are arranged so as to form the hollow elongated body as a whole, join one circumferential end of one of the covers and one circumferential end of another cover that are adjacent to each other so that a distance between another circumferential end of the one of the covers and another circumferential end of the other cover is adjustable.

2. The cover assembly according to claim 1, wherein an antenna element is housed within the housing space portion.

3. A cover assembly comprising:

a plurality of covers, outer shapes of the covers being respectively shapes obtained by dividing a hollow elongated body at predetermined intervals in a circumferential direction, and each of the covers having an internal housing space portion; and a mounting mechanism for mounting the covers on a pole located to be surrounded by an inner peripheral face of each of the covers in a state in which the covers are arranged to form a hollow elongated body as a whole, wherein the number of covers is n, n being an integer not less than 3, and the cover assembly further comprises a hinge portion adapted to, when a first cover to an n-th cover are sequentially arranged adjacent to each other in the circumferential direction so as to form the hollow elongated body as a whole, join a circumferential end of a k-th cover and a circumferential end of a (k+1)th cover that are adjacent to each other so that a distance between a circumferential end of the n-th cover and a circumferential end of the first cover that are adjacent to each other in the circumferential direction is adjustable, and k is an integer not less than 1 and not greater than n−1.

4. The cover assembly according to claim 3, wherein an antenna element is housed within the housing space portion.

* * * * *